US011608646B2

(12) United States Patent
Schäfers et al.

(10) Patent No.: US 11,608,646 B2
(45) Date of Patent: Mar. 21, 2023

(54) PANEL

(71) Applicant: AKZENTA PANEELE + PROFILE GMBH, Kaisersesch (DE)

(72) Inventors: Erich Schäfers, Demerath (DE); Hans-Jürgen Hannig, Bergisch Gladbach (DE)

(73) Assignee: AKZENTA PANEELE + PROFILE GMBH, Kaisersesch (DE)

( * ) Notice: Subject to any disclaimer, the term of this patent is extended or adjusted under 35 U.S.C. 154(b) by 0 days.

(21) Appl. No.: 17/252,569

(22) PCT Filed: Jun. 13, 2019

(86) PCT No.: PCT/EP2019/065465
§ 371 (c)(1),
(2) Date: Dec. 15, 2020

(87) PCT Pub. No.: WO2019/238811
PCT Pub. Date: Dec. 19, 2019

(65) Prior Publication Data

US 2021/0254349 A1 Aug. 19, 2021

(30) Foreign Application Priority Data

Jun. 15, 2018 (EP) ..... 18178064

(51) Int. Cl.
*E04F 15/02* (2006.01)
*E04F 15/10* (2006.01)

(52) U.S. Cl.
CPC ..... *E04F 15/02038* (2013.01); *E04F 15/102* (2013.01); *E04F 2201/0146* (2013.01); *E04F 2201/023* (2013.01)

(58) Field of Classification Search
CPC ..... E04F 15/02038; E04F 15/102; E04F 2201/0146; E04F 2201/023;
(Continued)

(56) References Cited

U.S. PATENT DOCUMENTS 2,740,167 A * 4/1956 Rowley ..... E04F 15/04 52/591.1
3,385,182 A * 5/1968 Harvey ..... E01C 9/083 52/579
(Continued)

FOREIGN PATENT DOCUMENTS

CA 3056031 A1 * 9/2018 ..... E04F 15/02038
CN 101400866 B * 12/2010 ..... E04B 1/68
(Continued)

OTHER PUBLICATIONS

English Translation of the International Preliminary Report on Patentability, dated Dec. 15, 2020, 8 Pages.
(Continued)

*Primary Examiner* — Brent W Herring
(74) *Attorney, Agent, or Firm* — Lucas & Mercanti, LLP; Klaus P. Stoffel

(57) ABSTRACT

A panel including an upper side, a lower side, a core and complementary locking elements provided in pairs on opposing panel edges. At least one pair of locking elements has complementary hook profiles, namely a receiving hook and an arresting hook. The receiving hook has a hook periphery arranged remote from the main body and a receiving recess arranged in the vicinity of the basic body. The receiving recess is open towards the panel upper side, and the arresting hook has an arresting recess, arranged in the vicinity of the basic body and open towards the panel lower side, and has an arresting shoulder remote from the basic body and which, in the vertical joining direction, fits into the receiving recess of the receiving hook. The arresting hook has a vertically locking arresting contour and the receiving hook has a form-fitting contour, which form fits with the arresting contour of the arresting hook. The arresting hook has, near the basic body, a horizontally locking retaining surface on its arresting shoulder and the receiving hook has
(Continued)

a horizontally locking retaining surface arranged remote from the basic body in the receiving recess. The receiving hook is provided with a sealing groove open to the panel upper side, and the arresting hook has a sealing strip projecting towards the panel lower side, which in the joined-together state of the complementary hook profiles fits into the sealing groove. The sealing groove and the sealing strip are arranged in the region of the panel core, and the surface of the sealing groove is formed from the material of the panel core and/or the surface of the sealing strip is formed from the material of the panel core.

16 Claims, 7 Drawing Sheets

(58) Field of Classification Search
CPC ..... E04F 13/00894; E04F 2201/03; E04F 15/105; E04F 2201/0138; E04F 2201/0161; E04F 2201/043; E04F 13/0894
USPC ..... 52/578, 588.1, 589.1
See application file for complete search history.

(56) References Cited

U.S. PATENT DOCUMENTS 6,345,481 B1 * 2/2002 Nelson ..... E04F 15/04 52/592.4
6,497,079 B1 * 12/2002 Pletzer ..... E04F 15/04 52/592.4
6,536,178 B1 * 3/2003 Pålsson ..... B44C 3/123 52/392
6,647,689 B2 * 11/2003 Pletzer ..... E04F 15/04 52/592.4
7,584,583 B2 * 9/2009 Bergelin ..... E04F 15/02033 52/588.1
8,191,334 B2 * 6/2012 Braun ..... E04F 15/02 52/747.11
8,245,478 B2 * 8/2012 Bergelin ..... E04C 2/24 52/592.1
8,375,672 B2 * 2/2013 Hannig ..... E04F 15/02038 52/588.1
8,495,849 B2 * 7/2013 Pervan ..... E04F 15/02 52/592.1
8,596,013 B2 * 12/2013 Boo ..... E04F 15/02038 52/588.1
8,806,832 B2 * 8/2014 Kell ..... E04G 23/0285 52/588.1
9,422,727 B2 * 8/2016 Sjoberg ..... E04F 15/02016
9,745,756 B2 * 8/2017 Hannig ..... E04F 15/02033
10,316,526 B2 * 6/2019 Kell ..... E04F 15/02038
11,015,351 B2 * 5/2021 De Rick ..... E04F 15/107
2003/0154681 A1 * 8/2003 Pletzer ..... E04F 15/04 52/578
2004/0123547 A1 * 7/2004 Grafenauer ..... E04F 15/02 52/578
2005/0050827 A1 * 3/2005 Schitter ..... B44C 5/043 52/578
2010/0043333 A1 * 2/2010 Hannig ..... E04F 15/02 52/582.2
2011/0138722 A1 * 6/2011 Hannig ..... E04F 15/02033 52/309.1
2018/0002933 A1 1/2018 Pervan
2019/0145108 A1 * 5/2019 Hannig ..... E04F 15/102 52/582.2
2020/0087926 A1 * 3/2020 Loebel ..... E04B 1/6179
2020/0232226 A1 * 7/2020 De Rick ..... E04F 15/102
2020/0277796 A1 * 9/2020 De Rick ..... E04F 15/02038

FOREIGN PATENT DOCUMENTS

CN 201671292 U 12/2010
DE 10252864 A1 * 5/2004 ..... E04F 15/02
EP 0624696 A2 11/1994
EP 1045083 A1 * 10/2000 ..... E04F 15/02
EP 3087230 B1 * 3/2018 ..... E04C 2/38
EP 3524750 A1 * 8/2019 ..... E04F 13/0889
WO 2007081267 A1 7/2007
WO WO-2008083662 A1 * 7/2008 ..... E04F 15/04
WO WO-2012126046 A1 * 9/2012 ..... E04F 15/10
WO WO-2016046800 A1 * 3/2016 ..... E04F 15/10
WO WO-2016113677 A1 * 7/2016 ..... E04F 15/02038

OTHER PUBLICATIONS

Chinese Office Action Appliaction 201980040330.4 dated Sep. 17, 2021, 8 Pages.

* cited by examiner

PANEL

The present application is a 371 of International application PCT/EP2019/065465, filed Jun. 13, 2019, which claims priority of EP 18178064.4, filed Jun. 15, 2018, the priority of these applications is hereby claimed and these applications are incorporated herein by reference.

BACKGROUND OF THE INVENTION

The invention concerns a panel comprising a panel top side, a panel underside, a panel core and complementary locking means provided in pair-wise relationship at mutually opposite panel edges, wherein at least one pair of locking means is provided with complementary hook profiles, namely a receiving hook and an arresting hook opposite thereto, with the proviso that the receiving hook has arranged remote from the main body a hook edge and arranged closer to the main body a receiving recess, wherein the receiving recess is open towards the panel top side and wherein the arresting hook is provided with an arresting recess arranged closer to the main body and open towards the panel underside and an arresting shoulder which is arranged remote from the main body and which fits in the perpendicular joining direction into the receiving recess of the receiving hook, wherein the arresting hook has an arresting contour with a vertical locking action and the receiving hook has a positively locking contour which for the purposes of vertical locking fits together in positively locking relationship with the arresting contour of the arresting hook, wherein the arresting hook has a horizontally locking holding surface arranged closer to the main body at its arresting shoulder and the receiving hook is provided with a horizontally locking holding surface arranged remote from the main body in the receiving recess, wherein the receiving hook is provided with a sealing groove open towards the panel top side and wherein the arresting hook has a sealing strip which projects with respect to the panel underside and which fits into the sealing groove in the assembled state of the complementary hook profiles.

WO 2007/081267 A1 discloses a panel of the general kind set forth which includes a panel core comprising moisture-sensitive material as well as complementary hook profiles on the moisture-sensitive panel core, namely a receiving hook and an arresting hook. The panel also has an elastic surface layer at a top side of the panel core. Lateral edges of the elastic surface layer can overlap and themselves form a hook-shaped connection. That state of the art proposes that a sealing means can be selectively contained in the region of the overlapping edges. Insofar therefore that a sealing means is included that overlapping edge on the side of the receiving hook can then be considered as a sealing groove and the overlapping edge on the side of the arresting hook can be considered as a sealing strip.

SUMMARY OF THE INVENTION

The object of the invention is to propose an improved panel with which the sealing action is to be more easily achieved.

According to the invention the object of the invention is attained in that the sealing groove and the sealing strip are arranged in the region of the panel core and the surface of the sealing groove is formed from the material of the panel core and/or the surface of the sealing strip is formed from the material of the panel core.

The invention departs from shielding the panel core from moisture in the region of the hook profiles. Instead a sealing groove is provided in the material of the panel core, and also a sealing strip.

If the panel core is made of a material which has the property of being able to absorb moisture and in so doing increases its volume that is referred to as swelling. The invention makes use of that property and departs from the notion of protecting the panel core from moisture. Instead a panel core is used, which has a swelling property so that the increase in volume that this entails can be utilised in order in that way to achieve a sealing action or in order to enhance that sealing effect.

It can also be desirable if the receiving hook with its horizontally locking holding surface in the receiving recess is so designed that a permanent prestressing against the horizontally locking holding surface of the arresting shoulder can be produced. In that way the two panel edges are elastically braced against each other, which holds the join at the panel top side closed. That promotes the sealing action afforded by means of the sealing groove and the sealing strip. The permanent prestressing can be achieved for example by a design configuration which provides an elastic deflection at the panel underside with the join at the panel top side being closed at the same time as well as a flat aligned orientation of the panel top sides of the locked panels.

In addition therefore it can be viewed as beneficial if the panel core includes a material which promotes swelling due to moisture. In the panel of the general kind set forth the attempt is made to prevent moisture from reaching the panel core.

In general it is known for panels of the general kind set forth, for the panel core to be produced from so-called swelling-proofed plates, the swelling proofing of which serves to counteract swelling, for example by adding a wax constituent in manufacture of the plate. The invention departs from that teaching and instead proposes dispensing with measures for swelling proofing or at least reducing the swelling proofing of the material of the panel core.

The panel core can easily include a wood fibre material. Preferably a wood fibre material affording reduced swelling proofing or entirely without swelling proofing is used for the panel according to the invention. A panel comprising a swelling-proofed wood fibre material can for example contain water-repellant constituents like wax. That reduces swelling of the wood fibre material depending on the respective added amount of the water-repellant constituent.

Wood fibre materials in accordance with this invention, besides high density fibreboard (HDF), medium-density fibreboard (MDF) and OSB board (oriented strand board), are also fibre-bearing composite materials like WPC (wood plastics composite) or NFRP (natural fibre reinforced plastics).

According to the invention the swelling property of the panel core is utilised to contribute to sealing off locked panel edges. The proposed measure provides that deeper regions of the panel core surprisingly remain free from moisture although water-repellant constituents in the wood fibre material are omitted or at least reduced. It has surprisingly been found that almost no more moisture penetrates under the level of the sealing groove and the sealing strip. Those regions of the hook profiles that cause locked panel edges to be held together, namely the arresting contour of the arresting hook and the positively locking contour of the receiving hook, remain dry. Corresponding tests in the region of T-joins have shown that water in the region of a T-join on a floor surface which is assembled from panels according to the invention, even after a long period, cannot percolate through to the underside of the floor covering.

Desirably the sealing strip is without an oversize relative to the sealing groove so that they can be easily fitted together.

It is helpful if the sealing groove is provided with mutually opposite side walls, has a groove bottom and is delimited distally by a groove edge projecting in the direction of the panel top side, wherein the side walls assume a wedge-shaped arrangement relative to each other, wherein the wedge angle is open towards the panel top side and wherein the wedge angle is in the range of 30° to 70°, preferably in the range of 40° to 60° and particularly preferably being 45° to 55° or alternatively in the range of 65° to 85°, wherein a wedge angle in the last-mentioned range affords a good sealing action and in addition enhances the stability of the profile, in particular with an edge angle of 80° the sealing groove and the sealing strip are of excellent strength which protects them from mechanical damage.

As has been found, it is particularly helpful to provide the proposed wedge-shaped arrangement of the side walls in such a way that the space between the side walls becomes narrower towards the bottom of the sealing groove. It also helps if then the sealing strip has outside surfaces which are matched to the wedge-shaped arrangement of the side walls of the sealing groove.

It further helps if the cross-section of the sealing groove has a respective round transition between the side walls and the groove bottom (for example a radius), unlike the state of the art shown in FIG. 5c of WO 2007/081267 where rectangular cross-sections are to be found. In that way round transitions and the avoidance of angular contours affords uniformity of the swelling effect which is to be utilised according to the invention for sealing purposes.

It is also beneficial to provide a round transition between the distal side wall and the groove edge in the cross-section thereof.

Upwardly adjoining the proximal side wall of the sealing groove is a butting surface which is preferably arranged perpendicularly to the panel top side.

The distal surface of the groove edge is preferably arranged perpendicularly to the panel top side.

Desirably provided on the arresting hook proximally relative to the sealing strip is a recess which is open downwardly in the direction of the panel underside. The upwardly projecting groove edge of the receiving hook is fitted in that downwardly open recess. Preferably the cross-section of the recess is larger than the cross-section of the groove edge, more specifically in such a way that, in the assembled state, formed between a top side of the groove edge and the bottom of the recess is a hollow space in which a sealing means or a hydrophobing means can possibly also be introduced.

It has proven to be beneficial if the sealing strip is adapted to the cross-sectional shape of the sealing groove. In that way it is possible to benefit from uniformity of the swelling effect by the avoidance of angular contours.

A further advantage is achieved in that there is provided a separate vertical locking element and the separate vertical locking element prior to locking of the panel edges is either integrated as a constituent part of the arresting contour of the arresting hook or is integrated as a constituent part of the positively locking contour of the receiving hook.

In a simple configuration the arresting contour of the arresting hook has a holding groove for the separate vertical locking element and the positively locking contour of the receiving hook also has a holding groove for the separate vertical locking element.

Desirably either the holding groove in the receiving hook or the groove in the arresting hook is arranged as a holding groove in order to be able to captively hold the separate vertical locking element prior to locking of the panel edges, wherein a part projecting from the holding groove of the separate vertical locking element is to be brought into engagement with the respective other groove during a joining operation. The separate vertical locking element can consequently be captively applied in the groove of the arresting hook. If in contrast it is to be captively held in the groove in the receiving hook then it optionally has to be applied in a modified orientation in the sense of a kinematic reversal, to ensure the correct function.

It has proven to be beneficial if both the holding groove in the receiving hook and also the groove in the arresting hook is open relative to the panel core in the distal direction.

Desirably the separate vertical locking element has a holding region which is provided for captive application of the vertical locking element by means of one of the grooves and a projecting part of the vertical locking element is provided with a retaining latch. In other words the holding region of the vertical locking element cooperates with the groove in which the vertical locking element is to be captively held.

The holding region and/or the retaining latch of the separate vertical locking element can be of a resilient configuration, namely for the purposes of automatic latchability of the retaining latch in a groove during a joining operation of complementary hook profiles. That measure permits automatic latching so that the vertical locking action is implemented automatically.

Desirably at least one panel edge provided with a hook profile is provided at the panel top side with an edge break or bevel. If both panel edges with complementary locking means have an edge break then in the assembled state of panels it is possible in that way to produce a covering surface with a visually attractive join. The join can be for example a V-join formed from two mutually opposite chamfers. A join has the advantage of protecting the panel edges, in particular a V-join, or the respective chamfer affords good protection for the respective panel edge.

An edge break can be provided with a coating. Desirably there is provided such a coating which at the surface of the edge break resists the absorption of moisture in the material of the panel core. For that purpose it is possible to use any suitable sealing coating material, for example a hydrophobing agent, a lacquer or a film or a combination of the three above-mentioned materials or comparable materials. Such a coating can also be provided on the upper butting surface and the upper counterpart butting surface cooperating therewith. The coating can extend from the respective edge break seamlessly on to the upper butting surface or the upper counterpart butting surface. A hydrophobing agent is possibly first applied. It can then be covered with a lacquer. Utilisation according to the invention of the swelling property of the material of the panel core is to begin only at those surfaces of the panel edge, that are beneath an edge break, and to deploy its effect where a sealing action by swelling of material is required and desired.

BRIEF DESCRIPTION OF THE DRAWING

The invention is described in detail by way of example hereinafter and illustrated in a drawing in which.

DETAILED DESCRIPTION OF THE INVENTION

Figure 1:
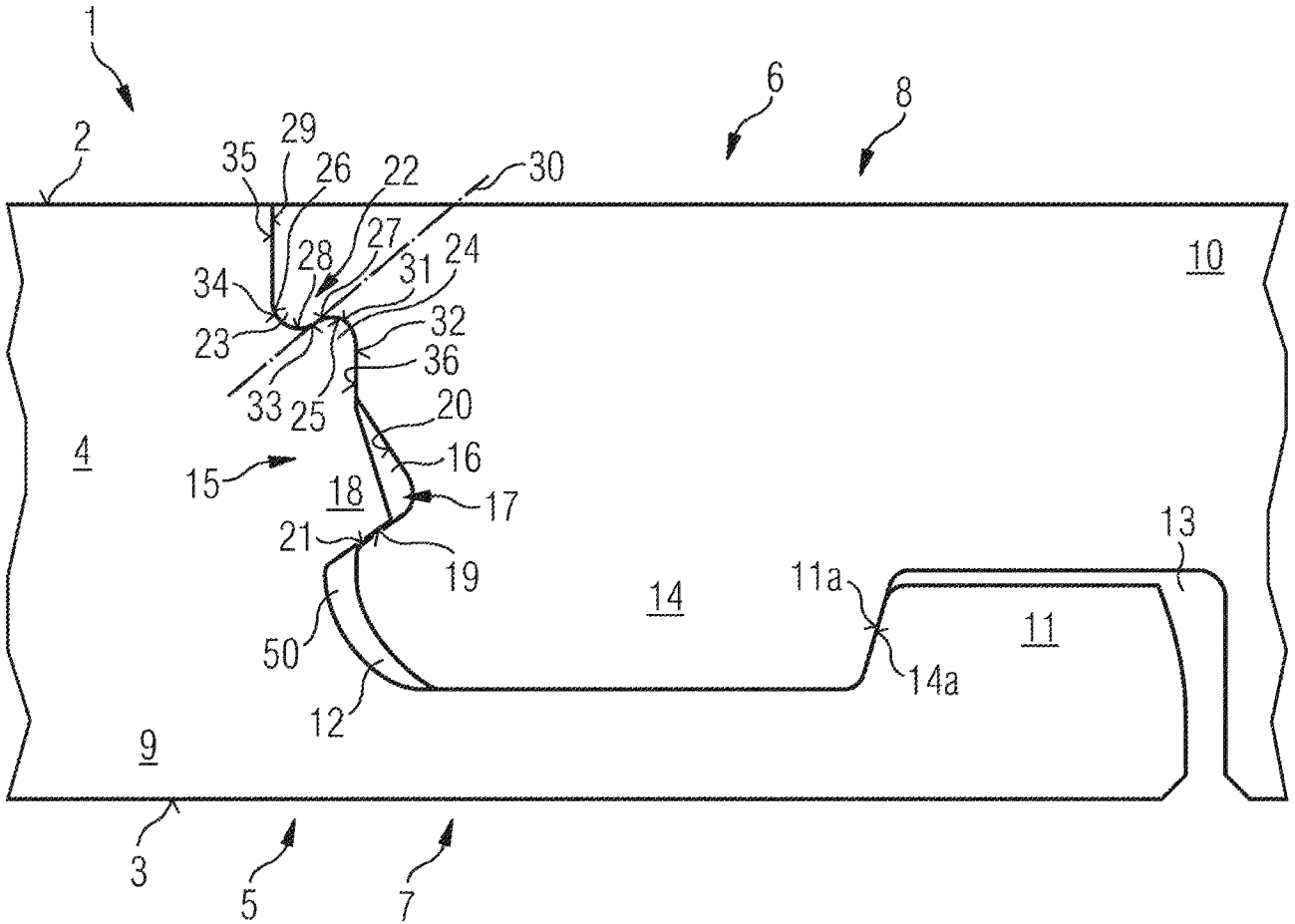
FIG. 1 shows a first pair of panel edges of the panel according to the invention in cross-section.

A first embodiment of a panel 1 according to the invention is shown in FIG. 1. It includes a panel top side 2, a panel underside 3, a panel core 4 and complementary locking means 5 and 6 which are provided in pair relationship at mutually opposite panel edges 7 and 8. The panel edges in FIG. 1 can be viewed as the panel edges that have belonged to a panel. In practice it is more specifically entirely usual to cut through panel, for example when the panel at the end of a row of panels is too long. It is then shortened to a suitable length and cut through for that purpose. The cut-off residual portion can generally be used to begin a new panel row. In that case the side with the cut surface is laid at the beginning of a new row so that the opposite end of that residual portion of panel has the appropriate locking means to continue the new row of panels and to lock a further panel thereto. Complementary locking means of a cut panel therefore always fit together and can be locked together, as shown in FIG. 1.

It will be appreciated that the panel edges of which a portion is shown in FIG. 1 can in principle also be viewed as the panel edges of two panels which have not been cut.

In accordance with the first embodiment the complementary locking means 5 and 6 of the panel are in the form of a pair of complementary hook profiles. One hook profile is a receiving hook 9 and the hook profile opposite thereto is an arresting hook 10 which fits thereto. In that arrangement the receiving hook 9 has a hook edge arranged remote from the main body and it has a receiving recess 12 closer to the main body. The receiving recess 12 is open towards the panel top side 2. The arresting hook 10 has an arresting recess 13 arranged closer to the main body and open towards the panel underside 3 and remote from the body it is provided with an arresting shoulder 14. The arresting shoulder 14 fits into the receiving recess 12 of the receiving hook 9 in the vertical joining direction, that is to say it can be moved down into the receiving recess 12 in a substantially vertical joining direction. In the locked state there is a gap between the bottom of the arresting recess 13 and the top of the hook edge 11. The arresting shoulder sits flat on the bottom of the receiving recess 12. Holding surfaces are provided for horizontal locking. They are intended to prevent locked panels from moving away from each other in the panel plane, more specifically perpendicularly to the panel edges. One of the holding surfaces 11*a* is arranged proximally at the hook edge. It delimits so-to-speak the receiving recess 12 of the receiving hook 9. The complementary holding surface 14*a* of the arresting hook 10 is provided proximally at the arresting shoulder 14.

In addition the arresting hook 10 has an arresting contour 15 which has a vertically locking action and which integrally comprises the material of the panel core 4. The arresting contour 15 includes an arresting groove 16 of an approximately triangular cross-section. The same material also constitutes a positively locking contour 17 which is provided at the receiving hook 9 and which, for the purposes of vertical locking, fits together in positively locking relationship with the arresting contour 15 of the arresting hook 10. The positively locking contour 17 is in the form of a distally projecting bar 18. The bar 18 is of an approximately triangular cross-section and has a locking surface 19, the surface normal of which is directed inclinedly towards the panel underside 3, and a free surface 20 whose surface normal is directed inclinedly towards the panel top side 2. The locking surface of the bar 18 cooperates with a groove wall 21 of the arresting groove.

Above the positively locking contour 17 the receiving hook 9 has a sealing groove 22 whose surface is formed from the material of the panel core 4.

Provided in matching relationship therewith above the arresting contour 15 of the arresting hook 10 is a sealing strip 23 which in turn is formed from the material of the panel core 4 and which fits snugly to the contour of the sealing groove 22.

The sealing groove 22 of the receiving hook 9 is delimited by a groove edge 24 projecting in the direction of the panel top side 2, wherein provided on the arresting hook 10 is a downwardly open recess 25 for the groove edge 24. The sealing groove 22 has a proximal side 26 and, towards the groove edge 22, a distal side 27 as well as a groove bottom 28. The groove bottom is of a convexly curved contour, that curvature also extending to the sides 26 and 27.

The proximal side wall 26 of the sealing groove 22 merges into an upper butting surface 29 arranged perpendicularly to the panel top side 2. The distal side wall 27 has a tangential line 30 as the transition to a concavely round contour forming the top side 31 of the groove edge 24. The groove edge 24 is delimited distally by a lower butting surface arranged perpendicularly relative to the panel top side 2.

A wedge-shaped cross-sectional region is formed between the upper butting surface 29 and the tangential line 30.

The sealing strip 23 of the arresting hook 10 is adapted to the above-described contour of the sealing groove 22 and is virtually of a matching wedge-shaped cross-section. The sealing strip 23 has a proximal strip side 33 which is oriented to the tangential line 30 and a distal strip side 34 which is adapted to the proximal side wall 26 and equally has a transition to an upper counterpart butting surface 35 which cooperates with the butting surface 29.

In matching relationship with the lower butting surface 32 of the receiving hook the arresting hook 10 is provided with a lower counterpart butting surface 36. The lower counterpart butting surface 36 is arranged between the downwardly open recess 25 and the arresting groove 16.

A wedge angle $\alpha$ of 50° is illustrated for the sealing strip of the FIG. 1 embodiment. It has also been found that an alternative configuration (not shown here) with a larger wedge angle $\alpha$ of 80° provides a good sealing action and in addition enhances the stability of the sealing strip and also the complementary sealing groove. In contrast there is a tendency for a reduction in the wedge angle to involve a certain risk of fracture of the sealing strip and the sealing groove.

That proposed wedge-shaped arrangement is advantageous for panels which have a panel core comprising a swelling material. The sealing groove and the sealing strip are easier to fit into each other than for example in the case of a sealing groove/sealing strip with parallel sides because they have to have a great deal of play in order to be able to be fitted one into the other, but they have a poor sealing action. Unlike that the wedge-shaped configuration promotes sealing integrity because the side wall 26 of the sealing groove 22 has contact with the distal strip side 34 of the sealing strip 23 and at the same time the distal side wall 27 of the sealing groove 22 is in contact with the proximal strip side 33 of the sealing strip. Differences in size of the cross-section of the sealing strip on the one hand and the cross-section of the sealing groove on the other hand are less critical than in structures whose sealing groove/sealing strip provide parallel pairs of surfaces for affording a sealing action.

Figure 2:
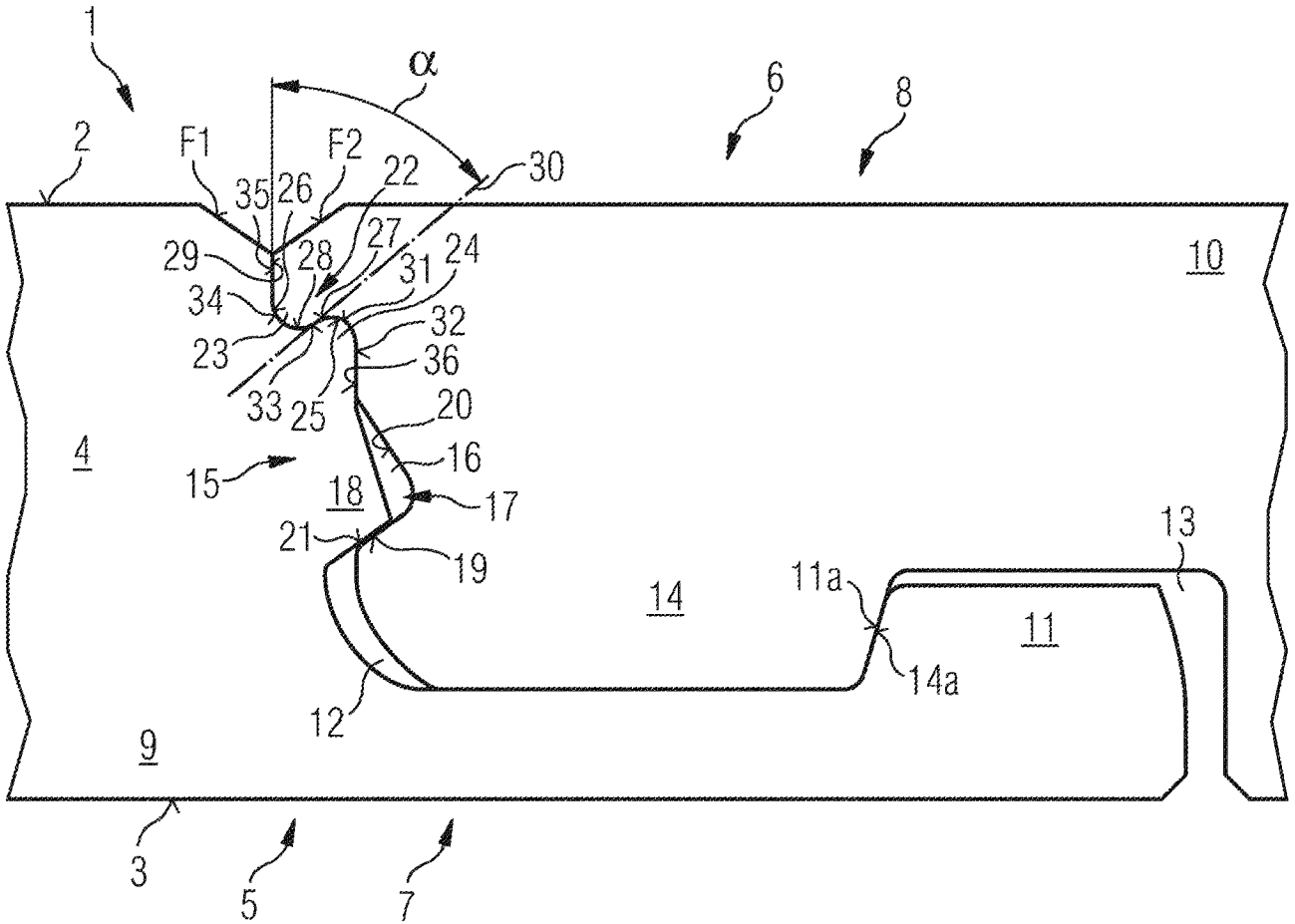
FIG. 2 shows a development of the panel with an alternative embodiment of the panel edge pair of FIG. 1.

FIG. 2 shows a development of the panel with an alternative configuration of the pair of panel edges. Unlike the previous embodiment a respective edge break or bevel is provided at both hook profiles at the panel top side 2. In other respect the configuration is identical to that of FIG. 1. At the receiving hook 9 the panel top side 2, at the panel edge, has an edge break K in the form of a chamfer F1 which here is inclined at an angle of 35° relative to the panel top side. Likewise the arresting hook 10 at the panel top side 2 is provided with an edge break K in the form of a chamfer F2 which is of mirror-image symmetry and matching relationship with the chamfer F1 of the receiving hook 9. The two chamfers protect the respective panel edges 7 and 8. The chamfer reduces the risk of rupture damage to the panel edge in question. Together the chamfers F1 and F2 form a V-join which is visually attractive and overall enhances the protection for a floor covering because fracture damage to the panel edges 7 and 8 is rarer and involves a lesser extent.

Figure 3:
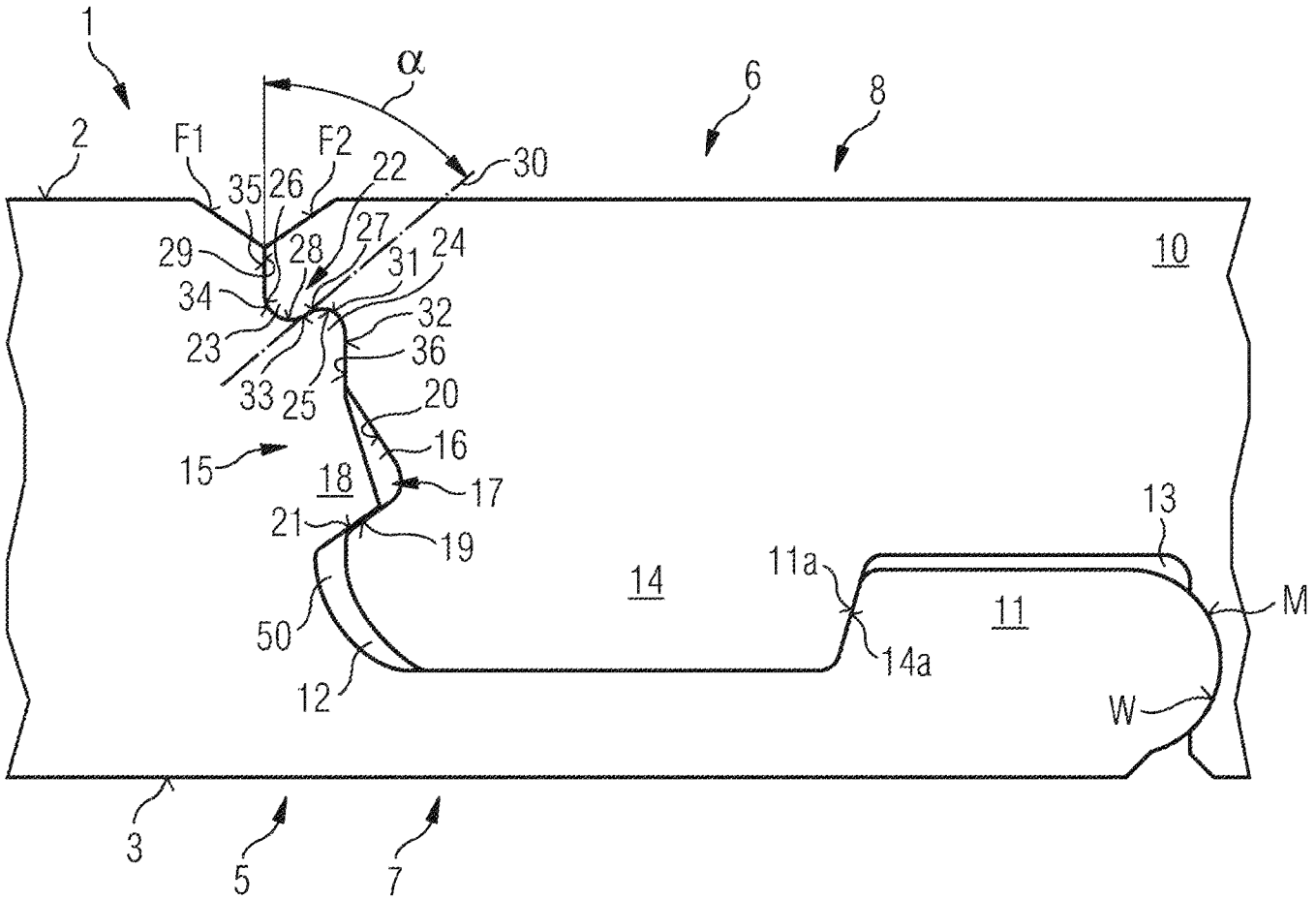
FIG. 3 shows a development of the panel with an alternative embodiment of the panel edge pair of FIG. 2.

FIG. 3 shows a development of that panel shown in FIG. 2. Likewise as in the previous embodiment it has edge breaks in the form of chamfers. In addition there is an additional second vertically locking configuration. For that purpose a distal surface of the hook edge 11 is provided with a male latching contour M which projects in the distal direction. In matching relationship therewith provided in the arresting recess 13 of the arresting hook 10 at a proximal surface is a female latching contour W which is in contact with the male latching contour and has a vertically locking action.

Figure 4:
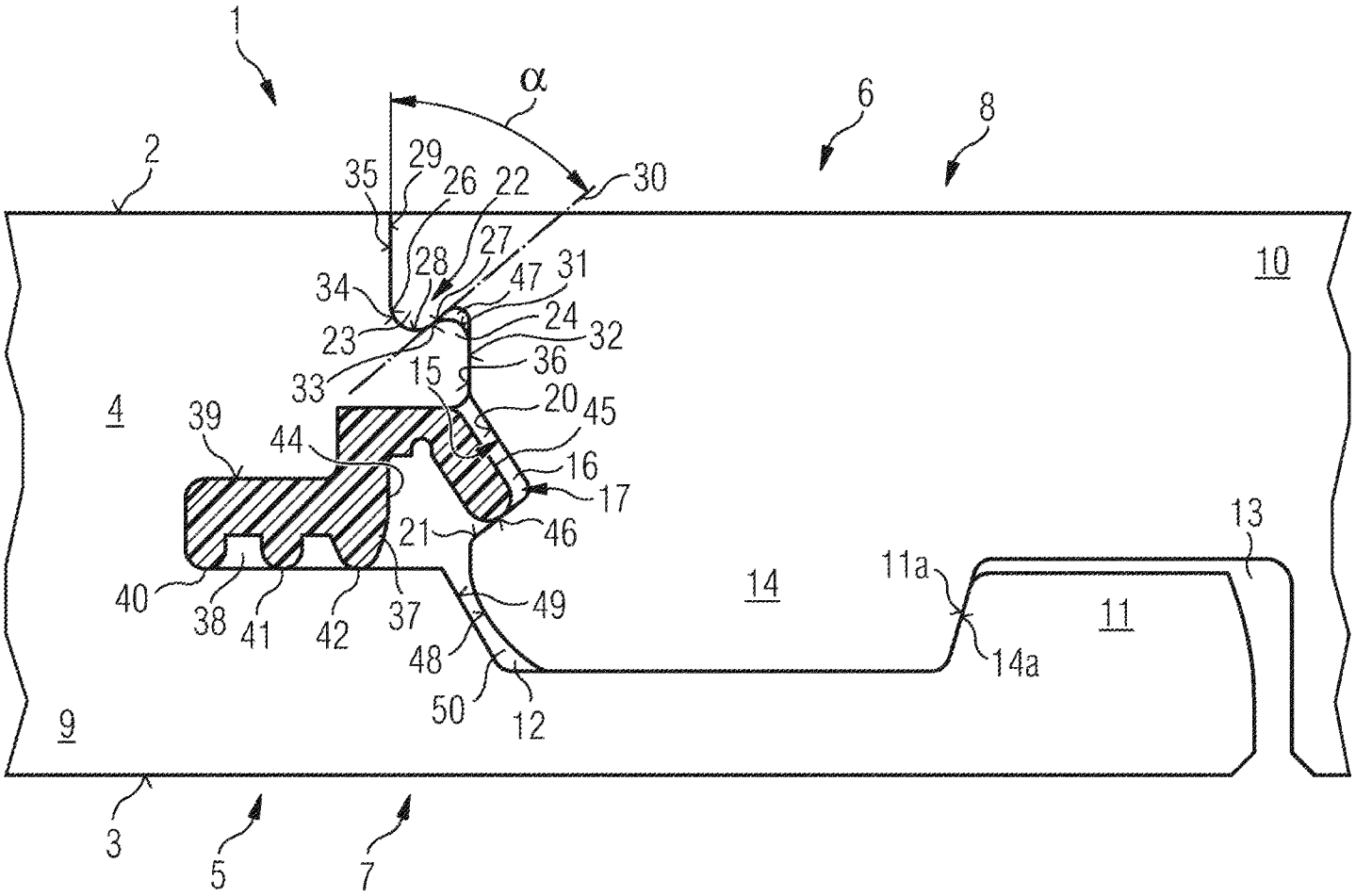
FIG. 4 shows an embodiment of the panel with a first pair of panel edges with a separate vertical locking element.

A further embodiment of the panel is shown in FIG. 4 which is based on the structure shown in FIG. 1. Unlike FIG. 1 the positively locking contour 17 of the receiving hook includes a separate vertical locking element 37 which is captively held in a holding groove 38 in the receiving hook 9. Prior to the manufacture of a panel covering the separate vertical locking element 37 is captively applied in the holding groove 38 provided for same in the receiving hook 9, which can be effected in automated fashion during manufacture of the panel, or separate vertical locking elements are added as individual parts when delivering panels in a suitable matching number. Prior to locking of complementary hook profiles then a respective vertical locking element has to be manually fitted in the holding groove 38 of the receiving hook 9.

A part 39 of the separate vertical locking element, that projects from the holding groove 38, forms a resilient retaining latch. That can be deflected back during a joining process by virtue of its elastic property when a complementary arresting hook is caused to butt against it. When the arresting hook is moved into the definitive locking position the projecting part of the separate vertical locking element can automatically return in the direction of its neutral position by means of resilient stressing thereof. That neutral position of the vertical locking element or its resilient retaining latch is at the same time also the vertically locking position which resists the hook profiles moving away from each other in a vertical direction.

The part of the cross-section of the separate vertical locking element 37 which is held captively in the holding groove 38 has for that purpose a holding region which has a back 39 and provided at one side on the back 39 transverse projections 40, 41 and 42 which in the applied state project in the direction of the panel underside 3 and extend as far as the oppositely disposed wall 43 of the holding groove 38. In relation to the width of the holding groove the captively inserted holding region of the separate vertical locking element 37 is of a certain oversize, for which reason the transverse projections 40, 41 and 42 with a certain degree of elastic deformation and prestressing provide for the desired captive retention in the holding groove 38. Opposite to the three transverse projections 40, 41 and 42 there is a neck 44 at an end of the back 39. The resilient retaining latch 45 in turn is continued at that neck 44. The resilient retaining latch 45 has a free end 46 which butts against the groove wall 21 of the arresting groove 16 of the arresting hook. The vertical locking action is created by means of that contact between the free end 46 and the groove wall 21. Desirably they are so matched to each other that the free end 46 of the retaining latch 45 always bears against the groove wall 21 with a remaining part of its resilient stressing. That concept can be so designed that even when there is a certain degree of wear of the hook profiles sufficient resilient stressing is always maintained and no play can be formed in the vertical direction between the locked hook profiles. In the FIG. 4 example the free end 46 of the resilient retaining strap faces downwardly towards the panel underside 3.

The configuration shown in FIG. 4 is modified in the region of the sealing groove 22 of the receiving hook and the sealing strip 23 of the arresting hook, more specifically disposed between the groove edge 24 and the downwardly open recess 25 there is some clearance or a hollow space 47 is provided there. The intention in that region of the contours is to ensure contact of the sealing strip 23 with the groove bottom 28 of the sealing groove. That is made easier if the arrangement dispenses with an additional contact between the groove edge 24 and the recess 25 by the removal of material at that location so that the hollow space 47 can be formed.

In the assembled state of the hook profiles a distal side surface 48 of the arresting shoulder 14 is at a spacing relative to a proximal side surface 49 of the receiving recess 12. Clearance or a gap 50 should also remain at that location. The gap at that location also promotes good interengagement of the sealing groove 22 and the sealing strip 23.

For the sake of completeness it should be mentioned that, in another configuration, the same separate vertical locking element 37 can be captively applied to the arresting hook 10. For that purpose the arresting groove 16 has to be modified in order to be able to captively hold the vertical locking element 37, more specifically in a kinematically reversed arrangement, so that the free end 46 of the resilient retaining latch 45 is directed upwardly towards the panel top side 2.

Figure 5:
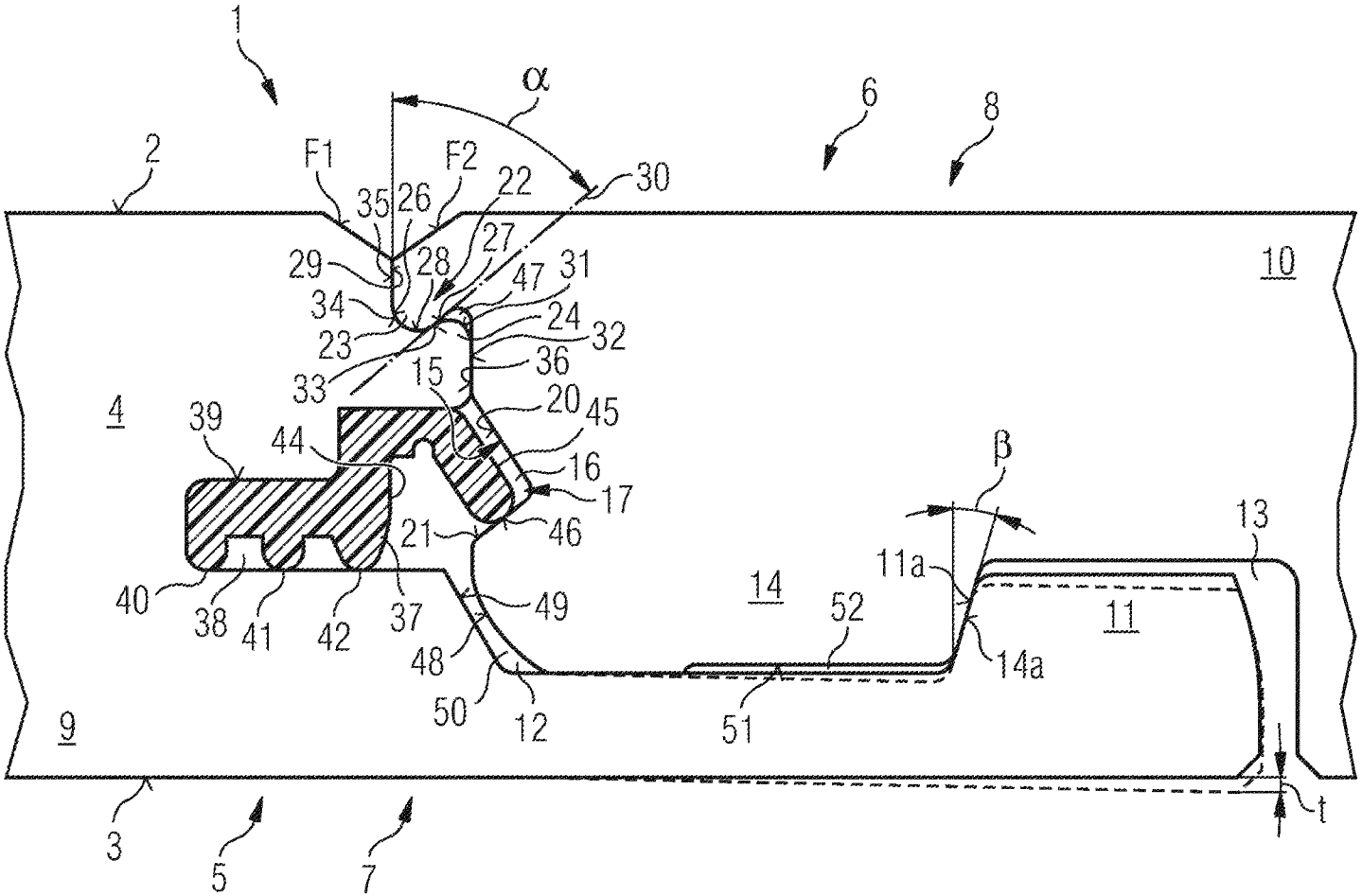
FIG. 5 shows a further embodiment of the panel with a first pair of panel edges with a separate vertical locking element.

A further embodiment as shown in FIG. 5, like the previous one, again has edge breaks in the form of chamfers F1 and F2. The chamfers when fitted together in mirror-image relationship jointly form a V-join. A difference in relation to the previous embodiment lies in the configuration of the arresting shoulder 14. As shown in FIG. 5 the underside of the arresting shoulder 14 is partly cut away, more specifically a proximal part of the underside is provided with a cut-away relief portion 51. In that way in the assembled state of the complementary hook profiles a gap 52 is formed between the relief portion 51 and the bottom of the receiving recess 12. A distal part of the underside of the arresting shoulder 14 retains contact with the bottom of the receiving recess 12. That configuration provides a certain degree of yielding flexibility of the receiving hook 9 at the panel underside 3. That flexibility is advantageous if a covering comprising panels according to the invention is to be laid on a humpy surface. An upwardly projecting hump on the surface, when positioned beneath locked hook profiles, can be somewhat compensated by the above-mentioned yielding flexibility. If the panel underside 3 is displaced upwardly because of a hump then all that happens is that the gap 52 is narrowed and it is possible to avoid or alleviate lifting of the panel top side 2.

FIG. 5 shows with a dotted line an alternative configuration which provides that in the locked state of two panel edges 7, 8 that upper join which is formed by the upper butting surface 29 in contact with the upper counterpart butting surface 35 is closed. In that case at the same time the holding surface 11*a* to be associated with the receiving hook 9 is in contact with the holding surface 14*a* to be associated with the arresting hook 10. The broken line indicates elastic bending at the receiving hook downwardly by the dimension t. The elastic bending causes permanent prestressing within the locking configuration, more specifically by means of an arrangement of the holding surfaces 11*a*/14*a* such that they are inclined with respect to the perpendicular to the plane of the panel by an angle β. That keeps in particular the above-mentioned join between the upper butting surface 29 and the upper counterpart butting surface 35 in a closed condition. The configuration proposed here for the hook profiles, which is intended to produce a permanent prestressing within the locking configuration and to close the upper join can obviously also be provided as an alternative in each of the embodiments of FIGS. 1 to 4.

Figures 6, 7:
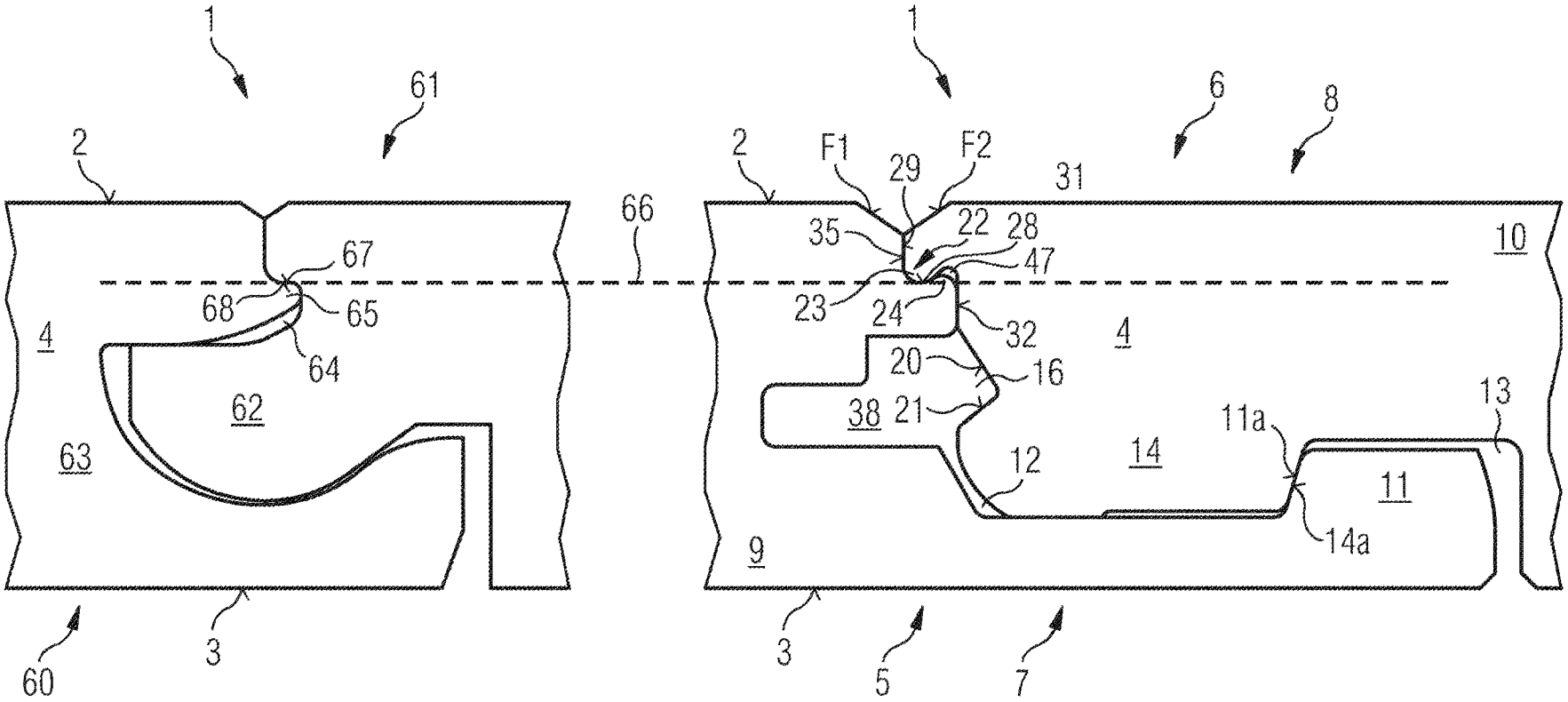
FIG. 6 shows a second pair of panel edges of the panel with a positively locking groove-and-tongue connection and with a sealing bar and a sealing groove in accordance with application EP 18155583.0.
FIG. 7 shows the first pair of panel edges shown in FIG. 5 with an empty groove for a vertical locking element.

Reference is now made to FIG. 6 to show a second pair of panel edges 60 and 61 of the panel, providing a positively locking tongue-and-groove connection. This pair of panel edges can be very well combined on a quadrangular panel with a first pair of edges having the complementary hook profiles according to the invention. The panel edges in FIG. 6 dispense with hook profiles and cannot be locked in a joining movement in a direction perpendicular to the panel plane. Instead one of the panel edges is provided with a tongue profile 62 and the complementary panel edge has a groove profile 63 so that this requires a joining movement which includes a component of movement of the panel edges towards each other in the plane of the panel. Preferably that panel having the tongue profile 62 is moved in a certain inclined position in the direction of the groove profile 63 of a lying panel and, when the tongue is fitted into the groove, the inclined panel is then pivoted down into the same plane as the already lying panel. The positively locking action is achieved by the downward pivotal movement.

The second pair of edges is of a configuration as proposed in patent application EP 18155583.0. Those panel edges in turn have means for sealing a join, that are intended to prevent percolation of water to the panel underside 3. For that purpose the tongue profile 62 is provided with a sealing groove 64 and the complementary groove profile 63 has a distally projecting sealing bar 65 which fits into the sealing groove 64. The sealing bar and the sealing groove are respectively disposed in the material of the panel core 4. In the case of the present panel core 4 that is a material which can and is intended to swell under the effect of moisture.

The sealing integrity of the panel according to the invention can be improved if it is in the form of a quadrangular panel and is designed as a second pair of edges with the positively locking tongue-and-groove profiles in accordance with EP 18155583.0.

It was also found that the sealing integrity of the quadrangular panel can be still further improved if a defined common sealing plane 66 is provided. The pair of edges with the hook profiles are to involve the same sealing plane like also the second pair of edges having the positively locking tongue-and-groove profiles (62, 63) in accordance with EP 18155583.0.

It is proposed for the purpose that that second pair of edges provided with the positively locking tongue-and-groove profiles is to be arranged in relation to the common sealing plane 64 that a top side 67 of the sealing bar 65 and an upper groove wall 68 of the sealing groove 64, which are in contact with each other as effective sealing surfaces, are arranged on the level of the common sealing plane 66.

In relation to the pair of edges having the hook profiles as shown in FIG. 7 the groove bottom 28 of the sealing groove 22 which is in contact with the sealing strip 23 is to be so arranged that the lowest point of the groove bottom 28 is likewise at the level of the common sealing plane 66 which is illustrated by FIGS. 6 and 7 which are shown side-by-side. Moreover the locking element 37 has been omitted from this view for the sake of simplicity; however the same locking element 37 as in FIGS. 4 and 5 is provided for the structure shown in FIG. 7.

In this way the arrangement provides that surfaces of both pairs of edges, that are in sealing contact with each other, because they are arranged in the same sealing plane 66, do not involve any gaps in the sealing action, even at the corners of the panels.

Figure 8:
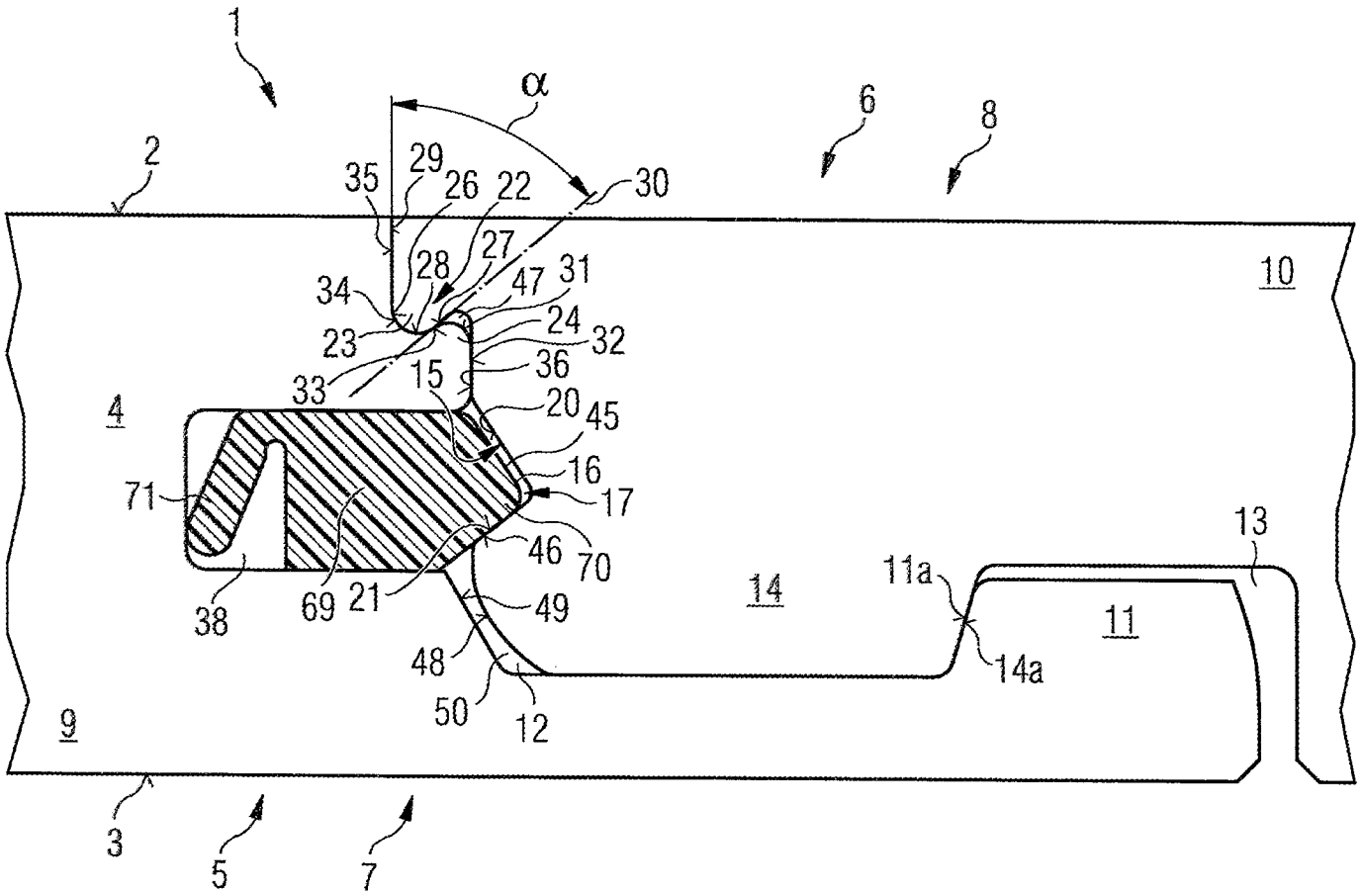
FIG. 8 shows a further embodiment with an alternative separate vertical locking element.

FIG. 8 again shows a panel 1 according to the invention, which is provided with a separate vertical locking element 69 for the purposes of vertical locking. Unlike the configurations shown in FIGS. 4 and 5 the vertical locking element 69 is provided with a retaining latch 70 which projects out of the holding groove 38 in the locked state of two panels. The vertical locking element 69 is resiliently provided at a rearward region which extends into the holding groove 38. That resilient holding region 71 is deemed to belong to the holding region in accordance with the invention because it projects into the holding groove 38. The function of the resilient holding region 71 however at least primarily involves storing spring energy and transmitting that as elastic prestressing forwardly into the retiaining latch 70 which in the locked state of two panels projects from the holding groove 38 as can be seen in FIG. 8. It will be appreciated that each embodiment of FIGS. 1 to 7 can be provided with the vertical locking element 69 proposed here, with the necessary adaptations in respect of the receiving holding groove 38, as an advantageous positively locking contour 17.

LIST OF REFERENCES

1 panel
2 panel top side
3 panel underside
4 panel core
5 locking means
6 locking means
7 panel edge
8 panel edge
9 receiving hook
10 arresting hook
11 hook edge
11*a* horizontally locking holding surface
12 receiving recess
13 arresting recess
14 arresting shoulder
14*a* horizontally locking holding surface
15 arresting contour
16 arresting groove
17 positively locking contour
18 bar
19 locking surface
20 free surface
21 groove wall (arresting groove)
22 sealing groove
23 sealing strip
24 groove edge
25 recess
26 proximal side wall
27 distal side wall
28 groove bottom
29 upper butting surface
30 tangential line
31 top side (groove edge)
32 lower butting surface
33 proximal strip side
34 distal strip side
35 upper counterpart butting surface
36 lower counterpart butting surface
37 separate vertical locking element
38 holding groove
39 back
40 transverse projection
41 transverse projection
42 transverse projection
43 groove wall
44 neck
45 resilient retaining latch
46 free end
47 hollow space
48 distal side surface
49 proximal side surface
50 gap
51 relief portion
52 gap
60 panel edge
61 panel edge
62 tongue profile
63 groove profile
64 sealing groove
65 sealing bar
66 common sealing plane
67 top side (sealing bar)
68 upper groove wall (sealing groove)
69 separate vertical locking element
70 retaining latch
71 resilient holding region
F1 chamfer
F2 chamfer
M male latching contour
W female latching contour
$\alpha$ wedge angle
$\beta$ angle

The invention claimed is:

1. A panel comprising a panel top side, a panel underside, a panel core and complementary locking means provided in pair-wise relationship at mutually opposite panel edges, wherein at least one pair of locking means is provided with complementary hook profiles, namely a receiving hook and an arresting hook opposite thereto, with the proviso that the receiving hook has arranged remote from the main body a hook edge and arranged closer to the main body a receiving recess, wherein the receiving recess is open towards the panel top side and wherein the arresting hook is provided with an arresting recess arranged closer to the main body and open towards the panel underside and an arresting shoulder which is arranged remote from the main body and which fits in the perpendicular joining direction into the receiving recess of the receiving hook, wherein the arresting hook has an arresting contour with a vertical locking action and the receiving hook has a positively locking contour which for the purposes of vertical locking fits together in positively locking relationship with the arresting contour of the arresting hook, wherein the arresting hook has a horizontally locking holding surface arranged closer to the main body at its arresting shoulder and the receiving hook is provided with a horizontally locking holding surface arranged remote from the main body in the receiving recess, wherein the receiving hook is provided with a sealing groove open towards the panel top side and wherein the arresting hook has a sealing strip which projects with respect to the panel underside and which fits into the sealing groove in the assembled state of the complementary hook profiles, wherein the sealing groove and the sealing strip are arranged in the region of the panel core and the surface of the sealing groove is formed from the material of the panel core and/or the surface of the sealing strip is formed from the material of the panel core, the panel further comprising a separate vertical locking element that, prior to locking of the panel edges, is either integrated as a constituent part of the arresting contour of the arresting hook or is integrated as a constituent part of the positively locking contour of the receiving hook, wherein the panel core has a swelling property, wherein the sealing groove smoothly transitions into a butting surface that extends toward and terminates at the panel top side, and wherein the sealing strip smoothly transitions into a counterpart butting surface that extends toward and terminates at the panel top side and abuts the butting surface in the assembled state of the complementary hook profiles.

2. The panel according to claim 1 wherein the panel core is made of a material which has the property of being able to absorb moisture and in so doing increase its volume.

3. The panel according to claim 1 wherein the panel core includes a wood fibre material.

4. The panel according to claim 1 wherein the sealing groove is provided with mutually opposite side walls, has a groove bottom and is delimited distally by a groove edge projecting in the direction of the panel top side, wherein the side walls assume relative to each other a wedge-shaped arrangement, wherein the wedge angle is open towards the panel top side and wherein the wedge angle is in the range of 30° to 70° or in the range of 65° to 85°.

5. The panel according to claim 4 wherein the cross-section of the sealing groove has a respective round transition between the side walls and the groove bottom.

6. The panel according to claim 5 wherein there is provided a round transition between the distal side wall and the groove edge in the cross-section thereof.

7. The panel according to claim 4, wherein the wedge angle is in the range of 40° to 60°.

8. The panel according to claim 7, wherein the wedge angle is in the range of 45° to 55°.

9. The panel according to claim 1 wherein the sealing strip is adapted to the cross-sectional shape of the sealing groove.

10. The panel according to claim 1 wherein the arresting contour of the arresting hook has a holding groove for the separate vertical locking element and the positively locking contour of the receiving hook also has a holding groove for the separate vertical locking element.

11. The panel according to claim 10 wherein either the holding groove in the receiving hook or the groove in the arresting hook is arranged as a holding groove in order to be able to captively hold the separate vertical locking element prior to locking of the panel edges, wherein a part projecting from the holding groove of the separate vertical locking element is to be brought into engagement with the respective other groove during a joining operation.

12. The panel according to claim 10 wherein both the holding groove in the receiving hook and also the groove in the arresting hook is open relative to the panel core in the distal direction.

13. The panel according to claim 10 wherein the separate vertical locking element has a holding region which is provided for captive application of the vertical locking element by means of one of the grooves and a projecting part of the vertical locking element is provided with a retaining latch.

14. The panel according to claim 13 wherein the holding region and/or the retaining latch of the separate vertical locking element is of a resilient configuration for the purposes of automatic latchability of the retaining latch in a groove during a joining operation of complementary hook profiles.

15. The panel according to claim 1 wherein at least one panel edge which is provided with hook profiles is provided with an edge break at the panel top side.

16. The panel according to claim 1, wherein the butting surface and the counterpart butting surface are perpendicular to the panel top surface.

* * * * *